US011339776B2

(12) United States Patent
Stephenson et al.

(10) Patent No.: US 11,339,776 B2
(45) Date of Patent: May 24, 2022

(54) CONFIGURATION AND OPERATION OF AN OPTIMIZED PUMPING SYSTEM

(71) Applicant: Halliburton Energy Services, Inc., Houston, TX (US)

(72) Inventors: Stanley V. Stephenson, Duncan, OK (US); Bryan John Lewis, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 286 days.

(21) Appl. No.: 16/342,091

(22) PCT Filed: Nov. 29, 2016

(86) PCT No.: PCT/US2016/063963
§ 371 (c)(1),
(2) Date: Apr. 15, 2019

(87) PCT Pub. No.: WO2018/101909
PCT Pub. Date: Jun. 7, 2018

(65) Prior Publication Data

US 2019/0249652 A1 Aug. 15, 2019

(51) Int. Cl.
*F04B 49/06* (2006.01)
*F04B 15/02* (2006.01)
(Continued)

(52) U.S. Cl.
CPC ..... *F04B 49/065* (2013.01); *E21B 43/121* (2013.01); *E21B 43/26* (2013.01);
(Continued)

(58) Field of Classification Search
CPC .... E21B 43/26; E21B 43/2607; E21B 43/121; F04B 47/02; F04B 47/00; F04B 17/05;
(Continued)

(56) References Cited

U.S. PATENT DOCUMENTS 3,249,053 A 5/1966 Govan
3,423,935 A * 1/1969 Budzich ..... A01B 63/1013 60/419

(Continued)

OTHER PUBLICATIONS

International Search Report and Written Opinion issued in related PCT Application No. PCT/US2016/063963 dated Aug. 21, 2017, 16 pages.

*Primary Examiner* — Peter J Bertheaud
(74) *Attorney, Agent, or Firm* — John Wustenberg; Baker Botts L.L.P.

(57) ABSTRACT

A pumping system pumps material downhole, for example, to perform a fracturing operation. The pumping system comprises one or more variable speed engines, one or more variable displacement hydraulic pumps and one or more intensifiers. According to the desired or required load, the speed of the engine is set at an optimal or most efficient operating speed. The volumetric displacement of the variable displacement hydraulic pump is set to provide the desired output volume and pressure of the material from the intensifier. Varying the speed of the engine and the volumetric displacement of the variable displacement pump allows for the pumping system and in particular the engine to operate at an optimal efficiency which reduces at least fuel costs and wear and tear on components.

19 Claims, 4 Drawing Sheets

(51) Int. Cl.

| | |
|---|---|
| ***F04B 17/05*** | (2006.01) |
| ***F04B 47/02*** | (2006.01) |
| ***E21B 43/12*** | (2006.01) |
| ***E21B 43/26*** | (2006.01) |
| ***F04B 47/00*** | (2006.01) |
| ***F04B 23/06*** | (2006.01) |

(52) U.S. Cl.
CPC ..... *E21B 43/2607* (2020.05); *F04B 15/02* (2013.01); *F04B 17/05* (2013.01); *F04B 23/06* (2013.01); *F04B 47/00* (2013.01); *F04B 47/02* (2013.01); *E21B 43/12* (2013.01); *F04B 2203/0605* (2013.01); *F04B 2203/0607* (2013.01); *F04B 2205/09* (2013.01)

(58) Field of Classification Search
CPC ..... F04B 49/065; F04B 23/06; F04B 2203/0605; F04B 2203/0607; F04B 2205/09; F02M 57/025; F02M 59/105
See application file for complete search history.

(56) References Cited

U.S. PATENT DOCUMENTS

| | | | | |
|---|---|---|---|---|
| 3,967,542 | A | 7/1976 | Hall et al. | |
| 4,077,746 | A | 3/1978 | Reynolds | |
| 6,712,043 | B2 * | 3/2004 | Sadfa | F02D 41/1448 123/447 |
| 7,451,742 | B2 * | 11/2008 | Gibson | F02M 59/105 123/446 |
| 2003/0021700 | A1 | 1/2003 | Serafin et al. | |
| 2009/0252616 | A1 | 10/2009 | Brunet et al. | |
| 2010/0310384 | A1 | 12/2010 | Stephenson et al. | |
| 2014/0255214 | A1 | 9/2014 | Burnette | |

* cited by examiner

CONFIGURATION AND OPERATION OF AN OPTIMIZED PUMPING SYSTEM

CROSS-REFERENCE TO RELATED APPLICATION

The present application is a U.S. National Stage Application of International Application No. PCT/US2016/063963 filed Nov. 29, 2016, which is incorporated herein by reference in its entirety for all purposes.

TECHNICAL FIELDS

The present disclosure relates generally to pumping systems, and more specifically (although not necessarily exclusively), to systems and methods for a pumping system that pumps fluid or material downhole.

BACKGROUND

In general, conventional positive displacement pumping systems included hydraulic pumps which may include a piston, a cylinder, and a pump chamber. The piston may reciprocate within the cylinder to compress or expand the volume of a pump chamber. One or more valves may provide for opening an inlet and an outlet of the pump chamber to allow fluid into the pump chamber in a suction stroke of the piston and fluid out of the chamber in the discharge stroke of the piston. A sealing member may be provided between the cylinder and the piston to prevent the fluid being pumped from leaking into the gap between the piston and the cylinder. Conventional pumps often rely on a source of mechanical power such as a motor or an engine, for example, a turbine, to provide the reciprocating movement to the piston. These conventional pumps do not allow for the turbine to be operated at an optimal fuel efficiency.

DETAILED DESCRIPTION

Figure 1:
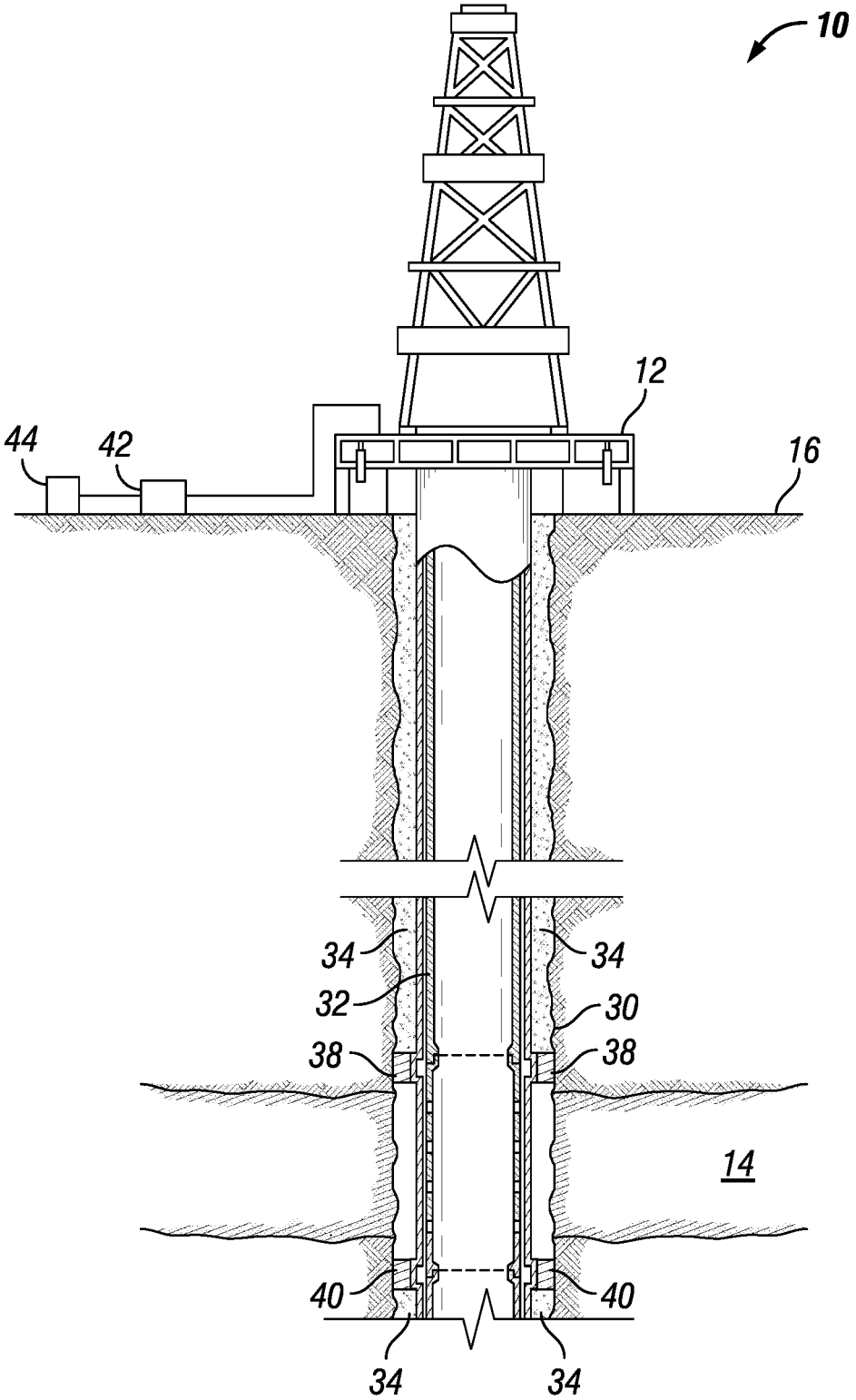
FIG. 1 is a schematic diagram of an apparatus for transferring material in a wellbore, according to one or more aspects of the present disclosure.

Certain aspects and features of the present disclosure relate to an efficient pumping system. The pumping system may include a turbine to power a hydraulic intensifier through one or more variable displacement hydraulic pumps (VDHP). A common problem or issue with some engine generated power, such as turbine power, is large efficiency drops when the engine is not operated at the optimal speed for a particular load. The present invention overcomes this problem by determining an operation mode or configuration of the pumping system and adjusting the turbine speed and volumetric displacement of the variable displacement hydraulic pumps based on this determination. The turbine may then operate at an optimal fuel efficiency and thus provide an efficient pumping system. Such optimal operation of the pumping system reduces costs associated with a given job or operation by reducing fuel costs, flameout of turbine engines, and wear and tear on components, extending fluid-end fatigue life and valve life while providing controlled pumping of materials downhole at the required pressure and volume. The use of longer stroked hydraulic intensifier pumps of the disclosed pumping system may also open the possibility of dwell time at the end of the strokes for automatically opened and closed fluid end valves (using valve actuators) that would minimize cavitation potential and valve wear. The disclosed pumping system may also allow for the pumping of long fibers, diverters, or other hard to pump materials or devices.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. The information handling system may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

FIG. 1 is a schematic diagram of an apparatus 10 for transferring material in a wellbore 30. Generally, apparatus 10 illustrates a system for transferring material from a surface-located hydrocarbon well site 12. The well site 12 is located over a hydrocarbon bearing formation 14, which is located below a ground surface 16. While well site 12 is illustrated at a ground surface 16, the present disclosure contemplates any one or more embodiments implemented at a well site at any location, including, at sea above a subsea hydrocarbon bearing formation. While one or more embodiments relate to a formation 14, a well site 12 or apparatus 10, the present disclosure contemplates use of a pumping system 42 at any other suitable location or for any other suitable purpose.

The wellbore 30 is formed through various earth strata including the formation 14. A pipe or casing 32 is insertable into the wellbore 30 and may be cemented within the wellbore 30 by cement 34. A centralizer/packer device 38 may be located in the annulus between the well bore 30 and the casing 32 just above the formation 14, and a centralizer packer device 40 is located in the annulus between the wellbore 30 and the casing 32 just below the formation 14. A pumping system 42 according to one or more aspects of the present disclosure is located at the well site 12. The pumping system 42 is configured to transfer material including but not limited to, water, linear gel, cross-linked gel, breaker, friction reducer, surfactant, biocide, sand, proppant, diverter, any other fluid (such as a well stimulation fluid) or any combination thereof. The pumping system 42 may be controlled by a control system 44 located at the well site 12 (as illustrated). In one or more embodiments, control system 44 may be located remote from the well site 12. In one or more embodiments, control system 44 may comprise one or more information handling systems, such as the information handling system 200 described with respect to FIG. 2.

Figure 2:
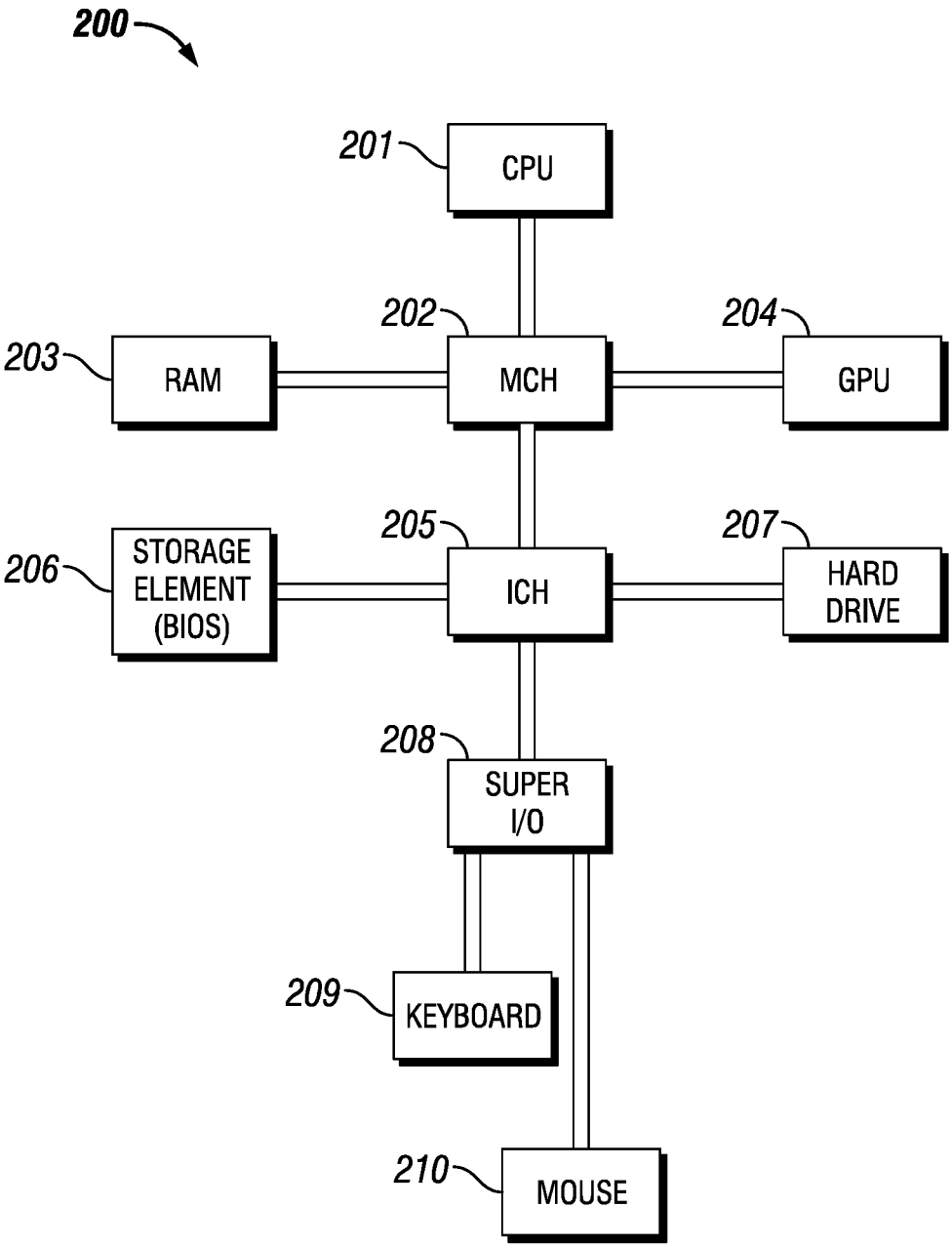
FIG. 2 is a diagram illustrating an example information handling system, according to one or more aspects of the present disclosure.

FIG. 2 is a diagram illustrating an example information handling system 200, according to aspects of the present disclosure. The control system 44 may take a form similar to the information handling system 200 or include one or more components of information handling system 200. A processor or central processing unit (CPU) 201 of the information handling system 200 is communicatively coupled to a memory controller hub or north bridge 202. The processor 201 may include, for example a microprocessor, microcontroller, digital signal processor (DSP), application specific integrated circuit (ASIC), or any other digital or analog circuitry configured to interpret and/or execute program instructions and/or process data. Processor 201 may be configured to interpret and/or execute program instructions or other data retrieved and stored in any memory such as memory 203 or hard drive 207. Program instructions or other data may constitute portions of a software or application for carrying out one or more methods described herein. Memory 203 may include read-only memory (ROM), random access memory (RAM), solid state memory, or disk-based memory. Each memory module may include any system, device or apparatus configured to retain program instructions and/or data for a period of time (e.g., computer-readable non-transitory media). For example, instructions from a software or application may be retrieved and stored in memory 203 for execution by processor 201.

Modifications, additions, or omissions may be made to FIG. 2 without departing from the scope of the present disclosure. For example, FIG. 2 shows a particular configuration of components of information handling system 200. However, any suitable configurations of components may be used. For example, components of information handling system 200 may be implemented either as physical or logical components. Furthermore, in some embodiments, functionality associated with components of information handling system 200 may be implemented in special purpose circuits or components. In other embodiments, functionality associated with components of information handling system 200 may be implemented in configurable general purpose circuit or components. For example, components of information handling system 200 may be implemented by configured computer program instructions.

Memory controller hub (MCH) 202 may include a memory controller for directing information to or from various system memory components within the information handling system 200, such as memory 203, storage element 206, and hard drive 207. The memory controller hub 202 may be coupled to memory 203 and a graphics processing unit (GPU) 204. Memory controller hub 202 may also be coupled to an I/O controller hub (ICH) or south bridge 205. I/O controller hub 205 is coupled to storage elements of the information handling system 200, including a storage element 206, which may comprise a flash ROM that includes a basic input/output system (BIOS) of the computer system. I/O controller hub 205 is also coupled to the hard drive 207 of the information handling system 200. I/O controller hub 205 may also be coupled to a Super I/O chip 208, which is itself coupled to several of the I/O ports of the computer system, including keyboard 209 and mouse 210.

In certain embodiments, the control system 44 may comprise an information handling system 200 with at least a processor and a memory device coupled to the processor that contains a set of instructions that when executed cause the processor to perform certain actions. In any embodiment, the information handling system may include a non-transitory computer readable medium that stores one or more instructions where the one or more instructions when executed cause the processor to perform certain actions. As used herein, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a computer terminal, a network storage device, or any other suitable device and may vary in size, shape, performance, functionality, and price. The information handling system may include random access memory (RAM), one or more processing resources such as a central processing unit (CPU) or hardware or software control logic, read only memory (ROM), and/or other types of nonvolatile memory. Additional components of the information handling system may include one or more disk drives, one or more network ports for communication with external devices as well as various input and output (I/O) devices, such as a keyboard, a mouse, and a video display. The information handling system 200 may also include one or more buses operable to transmit communications between the various hardware components.

Figure 3:
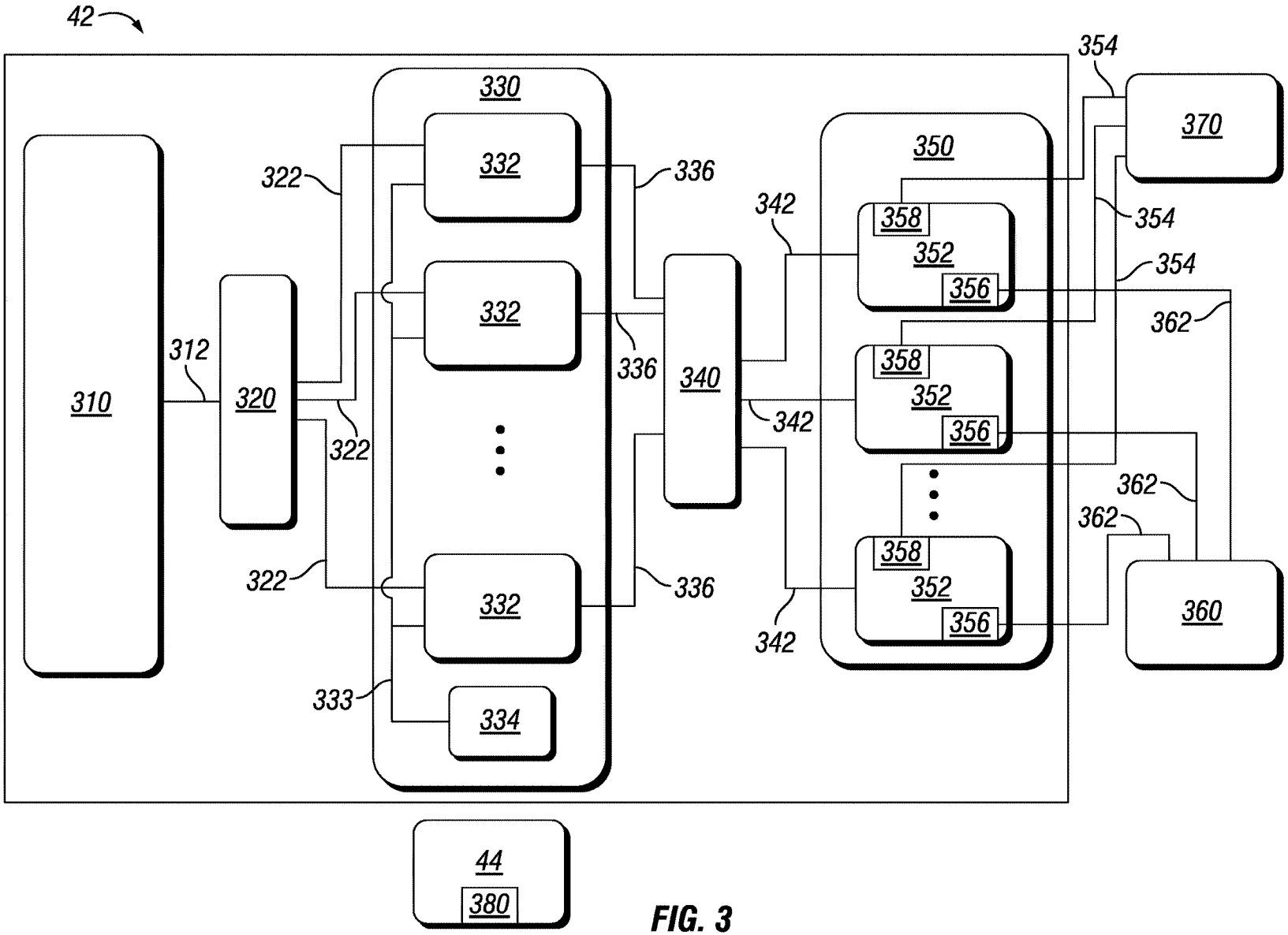
FIG. 3 is a schematic diagram of a pumping system for pumping materials downhole, according to aspects of the present disclosure.

FIG. 3 is a schematic diagram of a pumping system 42 for pumping materials 360 downhole, for example in wellbore 30, according to aspects of the present disclosure. In one or more embodiments, a pumping system 42 comprises an engine 310, a gearbox 320, a variable displacement hydraulic pumping system 330, an intensifier control system 340, an intensifier system 350. Any one or more components of the pumping system 42 may be located on the surface 16, a truck, a trailer, a barrel, a tank, a skid, a vessel, a railcar, any other vehicle or any other suitable location. The engine 310 may comprise an electric, diesel, gas, wind, water or any other suitable engine, motor or turbine for providing power to one or more variable displacement hydraulic pumps 332. For example, in one or more embodiments, engine or motor 310 may comprise one or more turbines. The type of engine 310 may depend on one or more factors including, but not limited to, any one or more of the efficiency of the engine 310, the required speed, torque level, power capacity, and pressure required by the variable displacement hydraulic pumping system 330, weight, size or power density of engine 310, cost of engine 310, and fuel type.

Power from the engine 310 may be transferred to or used to drive one or more variable displacement hydraulic pumps 332 via a gearbox 320. In one or more embodiments, gearbox 320 may comprise a transmission. A drive shaft or drive line 312 from engine 310 may couple to gearbox 320. Gearbox 320 may couple to one or more variable displacement hydraulic pumps 332 of the variable displacement hydraulic pump system 330. Gearbox 320 may couple to the high-speed shaft of the turbine and the low-speed shaft of the associated one or more variable displacement hydraulic pumps 332. For example, an engine 310 may comprise a turbine operating at an optimal rotations per minute (rpms) and the output from the turbine may be geared down by a ratio of the gearbox 320 to provide the required input rpms to a variable displacement hydraulic pump 332. In one or more embodiments, one or more engines 310 may couple to one or more corresponding gearboxes 320 via one or more drive lines 312. Each gearbox 320 may couple to any one or more variable displacement hydraulic pumps 332. In one or more embodiments, the gearbox 320 is not necessary and one or more engines 310 couple directly to one or more variable displacement hydraulic pumps 332.

Variable displacement hydraulic pumping system 330 may comprise one or more variable displacement hydraulic pumps 332 for pumping hydraulic fluid 334 to one or more intensifiers 352. In one or more embodiments, a pumping system 42 may comprise any number or quantity and any type of variable displacement hydraulic pumping systems 330. For example, in one or more embodiments, any number of variable displacement hydraulic pumps 332 may pump hydraulic fluid 334 to the one or more intensifiers 352. A variable displacement hydraulic pump 332 may comprise any type of variable displacement hydraulic pump 332 including, but not limited to, axial piston pump or bent axis pump. In one or more embodiments, hydraulic fluid 334 may be pumped through suction lines 333 by the variable displacement hydraulic pumps 332 from any hydraulic fluid source. The hydraulic fluid source may comprise a reservoir, a container, a truck, a trailer, a barrel, a tank or any combination thereof at the surface 16 or at any other location and may be disposed or positioned on or about any type of surface or vehicle including, but not limited to, a vessel, a railcar, or any other suitable device for storing hydraulic fluid or any combination thereof.

The variable displacement hydraulic pumps 332 are configured such that the flow rate and outlet pressure may be adjusted, altered or changed as the pump operates. For example, a variable displacement hydraulic pump 332 may comprise hydraulic cylinders (not shown). The volumetric displacement of the variable displacement hydraulic pump 332 is the difference between a fully retracted length and a fully extended length of the rod or shaft of a cylinder or the distance the cylinder can travel from a closed position to an open position. In one or more embodiments, the volumetric displacement of the variable displacement hydraulic pump 332 is adjusted to provide for the most efficient or optimal operation of the engine 310. In one or more embodiments, each volumetric displacement for each variable displacement hydraulic pump is set or determined individually or as a group.

Any one or more of the variable displacement hydraulic pumps 332 may be coupled to an intensifier control system 340 via one or more associated hydraulic fluid flow lines 336. Intensifier control system 340 may comprise or be coupled to an information handling system 200 for controlling the rate, volume and pressure of output of the received hydraulic fluid 334 from the fluid flow lines 336 to one or more intensifiers 352 via intensifier fluid flow lines 342. The intensifier control system 340 distributes the hydraulic fluid 334 from the one or more variable displacement hydraulic pumps 332 to the one or more intensifiers 352. The hydraulic fluid 334 may be conveyed, delivered or flowed to the one or more intensifiers 352 via any one or more of hydraulic fluid flow lines 342. Hydraulic fluid flow lines 342 may comprise any one or more of a valve, control line, surge tanks or any other tubing, device or mechanism that times or manages the delivery of the hydraulic fluid 334 to the one or more intensifiers 352 such that a relatively constant flow of hydraulic fluid 334 or other treatment fluid (not shown) is maintained.

The intensifier system 350 may comprise any one or more intensifiers 352. In one or more embodiments, one or more intensifiers 352 of intensifier system 350 are selected for a given operation such that all or any one or more intensifiers 352 may be selected. In one or more embodiments, the intensifier system 350 comprises one or more banks of intensifiers where each bank of intensifiers comprises one or more intensifiers 352. Any one or more intensifiers 352 of a bank of intensifiers may be selected and individually controllable. Any one or more intensifiers 352 of a bank of intensifiers may be grouped into groups where each group is individually controllable. For example, all intensifiers 352 associated with a first group of intensifiers of a first bank of intensifiers may be controlled as a group. In contrast, all intensifiers 352 associated with a second group of intensifiers of a second bank of intensifiers may be controlled individually. An intensifier control system 340, a control system 44 or any combination thereof may control or regulate the distribution of hydraulic fluid 334 to any one or more intensifiers 352 or bank of intensifiers.

In one or more embodiments, output fluid or material 360 to be pumped downhole is received at or drawn into a first inlet port 356 of intensifier 352. Material 360 may comprise cement, slurry, water, air, linear gel, cross-linked gel, break, friction reducer surfactant, biocide, sand, proppant, diverter or any other stimulation or fracking fluid. The intensifier 352 transforms the hydraulic power received via hydraulic fluid flow lines 342 to a force that pumps or flows the material 360 via an outlet port 358 to one or more output flow lines 354. The one or more output flow lines 354 may couple to one or more of a piping or tubing 370. Piping or tubing 370 may convey, transmit, flow or otherwise deliver the material 360 at a high pressure downhole. In one or more embodiments, the one or more output flow lines 354 may convey, transmit flow, or otherwise deliver the material 360 at a high pressure downhole.

In one or more embodiments, the pumping system 42 is controlled via a control system 44. Control system 44 may comprise one or more information handling systems 200 or one or more methods of control system 44 may be performed manually. Control system 44 may communicatively couple directly or indirectly, via a wire or wirelessly, or by any other communication system or combination thereof to any one or more components of the pumping system 42 including, but not limited to, the engine 310, the gearbox 320, the variable displacement hydraulic pump 332, the intensifier control system 332, the intensifier 352 or any combination thereof. In one or more embodiments, control system 44 comprises a fuel map 380. Fuel map 380 may comprise a custom fuel map and may be created for each engine 310. Fuel map 380 may be created based, at least in part, on any one or more fuel map factors, including, but not limited to, type of engine 310, type of fuel used to power the engine 310, altitude, ambient air temperature, humidity, required output pressure and flow rate of material 360, minimum, maximum or both volumetric displacement for each variable displacement hydraulic pump 332, number of available engines 310, number of available variable displacement hydraulic pumps 332, number or quantity of intensifiers 352 or any other suitable criteria. In one or more embodiments, the number or quantity of variable displacement hydraulic pumps 332, the number or quantity of engines 310, the number of quantity of intensifiers 352 are determined or selected (for example, by the control system 44) for a given operation based, at least in part, on the fuel map for each selected engine 310.

Figure 4:
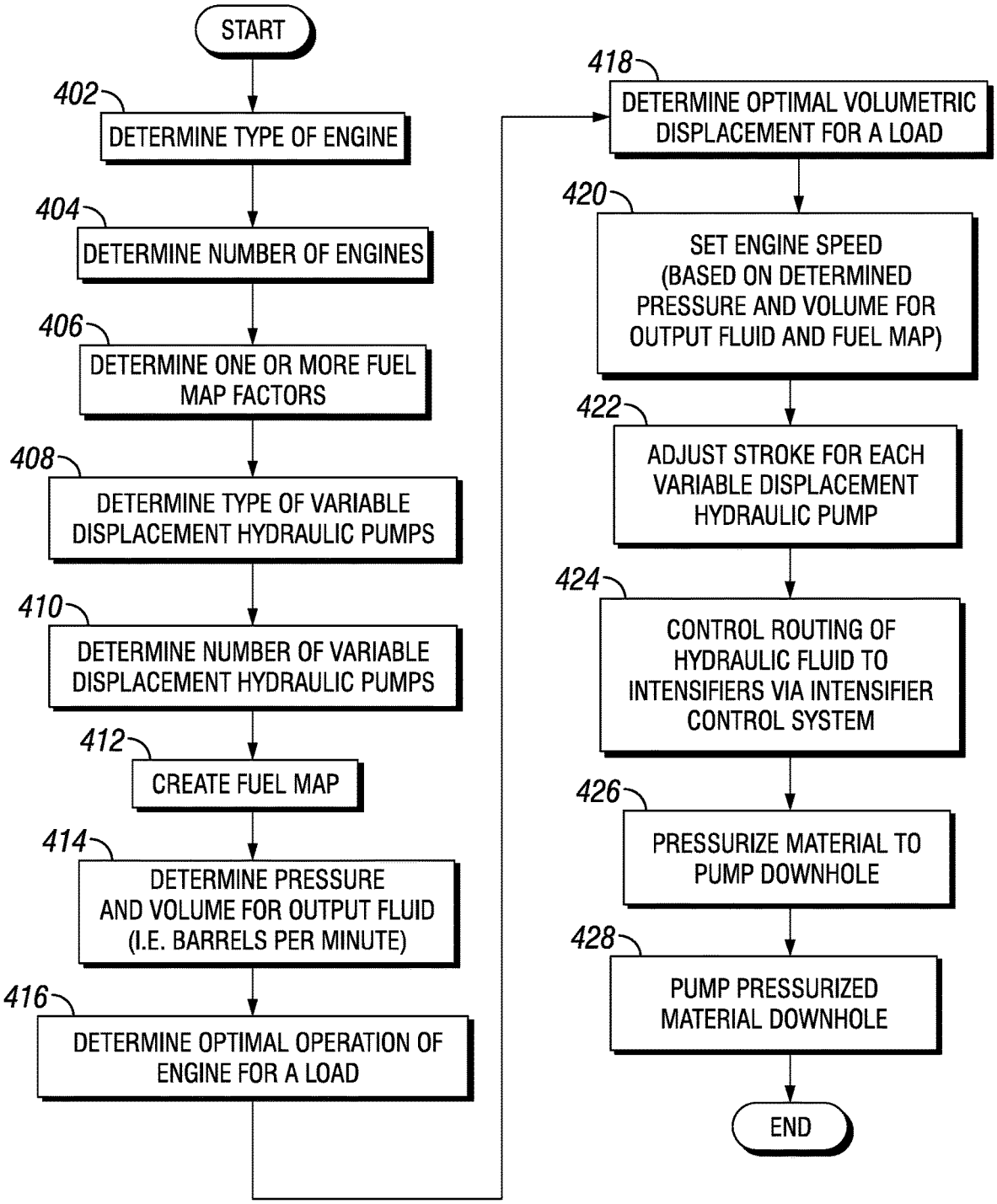
FIG. 4 is a flowchart of a method for pumping material downhole, according to aspects of the present disclosure.

FIG. 4 is a flowchart of a method for pumping material downhole, according to one or more aspects of the present invention. In one or more embodiments, one or more components, variables or factors associated with an operation or environment for pumping material downhole are selected or determined.

At step 402 the type of engine 310 for a given operation or environment is determined. For example, the type of engine 310 for an apparatus 10 as illustrated in FIG. 1. In one or more embodiments the type of engine 310 may be based, at least in part, on one or more factors. At step 404, the number or quantity of engines 310 is selected or determined. The number or quantity of engines 310 is determined based, at least in part, on one or more parameters including, but not limited to, a required hydraulic horsepower for the pumping operation, optimal load point for an engine, and reliability of the pumping equipment.

For each pumping operation, the required hydraulic horsepower may be determined as HHP=(Pressure*Flow Rate)/40.8 where "HHP" is the hydraulic horsepower, "Pressure" is the pressure of the fluid pumped downhole measured in pounds per square inch (psi) and "Flow Rate" is the flow rate for pumping the fluid downhole measured in barrels per minute. Alternatively, the required hydraulic power may be determined as Kw=(Bar*$dm^3$/min)/600 where "Kw" is power in kilowatts, "Bar" is system pressure and "$dm^3$/min" is flow rate measured in cubic decimeters per minute. Each variable displacement hydraulic pump 332 may produce a range of hydraulic horsepower. This range of hydraulic horsepower is determined by subtracting from the maximum and minimum horsepower rating of the associated engine 310 the parasitic losses of the variable displacement hydraulic pump 332 including, but not limited to, cooling systems, power for controls and auxiliary systems, and pump inefficiencies).

The optimal load point for a given engine 310 may depend on the one or more parameters of the engine 310 that are to be optimized. The one or more parameters to be optimized may include, but are not limited to, fuel efficiency, exhaust emissions, noise emissions, heat, or any other parameter of the engine 310. In one or more embodiments, an engine 310 may have a maximum horsepower rating but the engine 310 may be operated at a lower horsepower to optimize any one or more of these parameters.

In an ideal environment, the number or quantity of engines 310 would be determined as the total required hydraulic horsepower for a pumping operation divided by the optimal load point for each engine 310. For a given pumping operation, one or more variable displacement hydraulic pumps 330 or an engine 310 may be taken offline for maintenance or otherwise disconnected from the pumping system 42. The number or quantity of engines 310 may be increased to account for such expected and unexpected events so that the total required hydraulic horsepower may consistently or continuously be met. The number or quantity of such reserve or back-up engines may be determined based, at least in part, on the reliability of each engine 310 or the reliability of any other system components (for example, a variable displacement hydraulic pump 332, an intensifier 352, one or more valves, a control system 44, an intensifier control system 340 or any other one or more components). For example, a pumping system 42 that includes engines 310 selected with an associated high reliability rating requires fewer reserve engines 310 than a pumping system 42 that includes engines 310 with an associated lower reliability rating.

At step 406, one or more fuel map factors are determined. At steps 408 and 410, respectively, the type and number or quantity of variable displacement hydraulic pumps 332 is determined. At step 412, a fuel map 380 is created for each engine 310 selected or determined at step 404. At step 414, a pressure and volume for the output fluid or material 360 is determined. For example, the pressure and volume for the output fluid or material 360 to be pumped at may be based, at least in part, on the barrels per minute of fluid flow required for a given operation.

At step 416, one or more operating modes or the optimal operation mode for each engine 310 for the expected or required load is determined. For example, an engine 310 may comprise different optimal operating modes for different loads. An operating mode of an engine 310 may include controlling or managing any one or more of speed, a torque, horsepower, timing, air intake, temperature, exhaust, type of fuel, any other factor, or any combination thereof of the engine 310. At step 418, the optimal volumetric displacement for each variable displacement hydraulic pump 332 for the expected or required load is determined based, at least in part, on the created fuel map. For example, the volumetric displacement is set so that an optimal operating mode for the engine 310 is maintained. Maintaining the engine 310 at the optimal operating mode or the selected operating mode may increase efficiency of the engine 310 and reduce costs associated with a given operation.

The required load, for example, may be based, at least in part, on the pressure and volume for pumping the output fluid or material 360 of FIG. 3. At step 420, the speed for each engine 310 is set based, at least in part, on the determined pressure and volume for the required output fluid or material 360 and the associated fuel map 380 created at step 412. Output pressure from any of the one or more intensifiers 352 is defined by the resistance of pumping the output fluid or material 360 downhole. This resistance may be due to any or more factors including, but not limited to, fluid losses in any piping or flow lines at the surface 16 or in wellbore 30, fluid losses in the wellbore 30, fluid losses at one or more perforations, fractures, or crevices in the formation 14 and stress required to push formation rocks apart. Each variable displacement hydraulic pump 332 is operated at a given flow rate necessary to sustain or maintain the required output pressure for the output fluid or material 360. The flow rate for each variable displacement hydraulic pump 332 may be determined by determining the required output pressure and the flow rate the variable displacement hydraulic pump 332 can achieve at a predetermined optimal load point for the associated engine 310. As variable displacement hydraulic pumps 332 having a variable volumetric displacement, the speed of an engine 310 does not directly determine the flow rate for an associated variable displacement hydraulic pump 332. The speed of each engine 310 may be independently determined and set so as to operate the engine 310 at the optimal speed for a given load.

At step 422, the volumetric displacement for each variable displacement hydraulic pump is adjusted. The volumetric displacement of each variable displacement hydraulic pump 332 is changed to accommodate the required flow rate and output pressure given that the engine 310 is operating at a speed associated with an optimal load point. At step 424, hydraulic fluid 334 is pumped to one or more intensifiers 352 by any one or more variable displacement hydraulic pumps 332. The routing of the hydraulic fluid 334 to any one or more intensifiers 352 is controlled via the intensifier control system 340. For example, the hydraulic fluid 334 may be routed to a number or quantity of intensifiers 352. The number or quantity of intensifiers 352 may be based, at least in part, on the required pressure and volume that the output fluid or material 360 must be pumped at for a given operation. At step 426, the output fluid or material 360 is pressurized for pumping downhole by the one or more intensifiers 352. At step 428, the pressurized output fluid or pressurized material 360 is pumped downhole. For example, the one or more intensifiers 352 pump the pressurized output fluid or material 360 downhole via one or more output flow lines 354, one or more output flow lines 354 coupled to piping or tubing 370, or piping or tubing 370. In one or more embodiments, the pressurized output fluid or material 360 may be pumped at a given pressure and flow rate to penetrate the formation 14 so as to create a fracture in the formation 14. An output fluid or material 360 may then be pumped downhole at a pressure and flow rate so as to inject proppant into any created fracture to keep the fracture open after pressure is released to accelerate the rate of hydrocarbon recovery from the formation 14.

In one or more embodiments, a pumping system comprises an engine, a variable displacement hydraulic pump coupled to the engine, wherein the engine drives the variable displacement hydraulic pump, and wherein the variable displacement hydraulic pump comprises a volumetric displacement that is based, at least in part, on the engine, an intensifier coupled to the variable displacement hydraulic pump and an output fluid, wherein the intensifier pressurizes the output fluid based, at least in part, on a hydraulic fluid pumped from the variable displacement hydraulic pump. In one or more embodiments, the pumping system further comprises a gearbox coupled between the engine and the variable displacement hydraulic pump. In one or more embodiments, the pumping system further comprises an intensifier control system coupled between the variable displacement hydraulic pump and the intensifier, wherein the intensifier control system distributes the hydraulic fluid from the variable displacement hydraulic pump to the intensifier. In one or more embodiments, the pumping system further comprises an information handling system coupled to the engine, wherein the information handling system comprises a fuel map associated with the engine, and wherein a speed of the engine is based, at least in part, on the fuel map. In one or more embodiments, the pumping system further comprises a piping coupled to the intensifier, wherein the piping conveys the pressurized outlet fluid downhole. In one or more embodiments, the variable displacement hydraulic pump of the pumping system comprises a plurality of variable displacement hydraulic pumps, and wherein each volumetric displacement for each of the plurality of variable displacement hydraulic pumps is individually set. In one or more embodiments, the intensifier of the pumping system comprises a plurality of intensifiers, and wherein distribution of the hydraulic fluid to each of the plurality of intensifiers is based, at least in part, on a fuel map.

In one or more embodiments, a method for pumping comprises determining an operating speed for an engine based, at least in part, on a fuel map, determining a volumetric displacement for a variable displacement hydraulic pump based, at least in part, on a fuel map, driving the variable displacement hydraulic pump by the engine, pumping hydraulic fluid from the variable displacement hydraulic pump to an intensifier, pressurizing the output fluid by the intensifier and pumping the pressurized output fluid from the intensifier at a determined pressure and volume. In one or more embodiments, the method for pumping further comprises creating the fuel map based, at least in part, on any one or more of a type of the engine, a number of available engines, a number of available variable displacement hydraulic pumps, or one or more operating modes for the number of available engines. In one or embodiments, the method for pumping further comprises adjusting a volumetric displacement of the variable displacement hydraulic pump to maintain the operating mode of the engine. In one or more embodiments of the method for pumping, the engine comprises a plurality of engines, wherein the variable displacement hydraulic pump comprises a plurality of variable displacement hydraulic pumps, and the intensifier comprises a plurality of intensifiers. In one or more embodiments, the method for pumping further comprises selecting at least one engine from the plurality of engines, setting a speed for each of the selected engines based, at least in part on the fuel map, selecting at least one variable displacement hydraulic pump from the plurality of variable displacement hydraulic pumps, setting a volumetric displacement for each of the selected variable displacement hydraulic pumps based, at least in part on the fuel map, and routing the hydraulic fluid to at least one of the plurality of intensifiers, wherein the routing is based, at least in part, on maintaining a pressure and a volume of the output fluid. In one or more embodiments, the method for pumping further comprises controlling the routing of the hydraulic fluid via an intensifier control system.

In one or more embodiments, a non-transitory computer-readable medium storing one or more executable instructions that, when executed, causes one or more processors to determine an operating speed for an engine based, at least in part, on a fuel map, determine a volumetric displacement for a variable displacement hydraulic pump based, at least in part, on a fuel map, drive the variable displacement hydraulic pump by the engine, pump hydraulic fluid from the variable displacement hydraulic pump to an intensifier, pressurize the output fluid by the intensifier, and pump the pressurized output fluid from the intensifier at a determined pressure and volume. In one or more embodiments of the non-transitory computer-readable medium, the one or more executable instructions, when executed, further cause the one or more processors to create the fuel map based, at least in part, on any one or more of a type of the engine, a number of available engines, a number of available variable displacement hydraulic pumps, or one or more operating modes for the number of available engines. In one or more embodiments of the non-transitory computer-readable medium, the one or more executable instructions, when executed, further cause the one or more processors to adjust a volumetric displacement of the variable displacement hydraulic pump to maintain the operating mode of the engine. In one or more embodiments of the non-transitory computer-readable medium, the engine comprises a plurality of engine, the variable displacement hydraulic pump comprises a plurality of variable displacement hydraulic pumps and the intensifier comprises a plurality of intensifiers. In one or more embodiments of the non-transitory computer-readable medium, the one or more executable instructions, when executed, further cause the one or more processors to adjust, individually, the volumetric displacement of each of the plurality of variable displacement hydraulic pumps to maintain the operating mode of the engine. In one or more embodiments of the non-transitory computer-readable medium, the one or more executable instructions, when executed, further cause the one or more processors to select at least one engine from the plurality of engines, set a speed for each of the selected engines based, at least in part on the fuel map, select at least one variable displacement hydraulic pump from the plurality of variable displacement hydraulic pumps, set a volumetric displacement for each of the selected variable displacement hydraulic pumps based, at least in part on the fuel map and route the hydraulic fluid to at least one of the plurality of intensifiers, wherein the routing is based, at least in part, on maintaining a pressure and a volume of the output fluid. In one or more embodiments of the non-transitory computer-readable medium, the one or more executable instructions, when executed, further cause the one or more processors to control the routing of the hydraulic fluid via an intensifier control system.

The foregoing description of certain aspects, including illustrated aspects, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A pumping system comprising:

an engine;

a variable displacement hydraulic pump coupled to the engine, wherein the engine drives the variable displacement hydraulic pump, and wherein the variable displacement hydraulic pump comprises a volumetric displacement that is based, at least in part, on the engine;

an intensifier coupled to the variable displacement hydraulic pump;

an output fluid, wherein the intensifier pressurizes the output fluid based, at least in part, on a hydraulic fluid pumped from the variable displacement hydraulic pump; and an information handling system coupled to the pumping system and configured to:

determine an operating speed of the engine based, at least in part, on a fuel map associated with the engine; and determine the volumetric displacement of the variable displacement hydraulic pump based, at least in part, on the fuel map.

2. The pumping system of claim 1, further comprising a gearbox coupled between the engine and the variable displacement hydraulic pump.

3. The pumping system of claim 1, further comprising an intensifier control system coupled between the variable displacement hydraulic pump and the intensifier, wherein the intensifier control system distributes the hydraulic fluid from the variable displacement hydraulic pump to the intensifier.

4. The pumping system of claim 1, further comprising a piping coupled to the intensifier, wherein the piping conveys the pressurized outlet fluid downhole.

5. The pumping system of claim 1, wherein the variable displacement hydraulic pump comprises a plurality of variable displacement hydraulic pumps, and wherein each volumetric displacement for each of the plurality of variable displacement hydraulic pumps is individually set.

6. The pumping system of claim 1, wherein the intensifier comprises a plurality of intensifiers, and wherein distribution of the hydraulic fluid to each of the plurality of intensifiers is based, at least in part, on a fuel map.

7. A method for pumping, comprising:

determining an operating speed for an engine based, at least in part, on a fuel map;

determining a volumetric displacement for a variable displacement hydraulic pump based, at least in part, on a fuel map;

driving the variable displacement hydraulic pump by the engine;

pumping hydraulic fluid from the variable displacement hydraulic pump to an intensifier;

pressurizing an output fluid by the intensifier; and pumping the pressurized output fluid from the intensifier at a determined pressure and volume.

8. The method for pumping of claim 7, further comprising creating the fuel map based, at least in part, on any one or more of a type of the engine, a number of available engines, a number of available variable displacement hydraulic pumps, or one or more operating modes for the number of available engines.

9. The method for pumping of claim 7, further comprising adjusting a volumetric displacement of the variable displacement hydraulic pump to maintain the operating mode of the engine.

10. The method for pumping of claim 7, wherein the engine comprises a plurality of engines, wherein the variable displacement hydraulic pump comprises a plurality of variable displacement hydraulic pumps and the intensifier comprises a plurality of intensifiers.

11. The method for pumping of claim 10, further comprising:

selecting at least one engine from the plurality of engines;

setting a speed for each of the selected engines based, at least in part on the fuel map;

selecting at least one variable displacement hydraulic pump from the plurality of variable displacement hydraulic pumps;

setting a volumetric displacement for each of the selected variable displacement hydraulic pumps based, at least in part on the fuel map; and routing the hydraulic fluid to at least one of the plurality of intensifiers, wherein the routing is based, at least in part, on maintaining a pressure and a volume of the output fluid.

12. The method for pumping of claim 11, further comprising controlling the routing of the hydraulic fluid via an intensifier control system.

13. A non-transitory computer-readable medium storing one or more executable instructions that, when executed, causes one or more processors to:

determine an operating speed for an engine based, at least in part, on a fuel map;

determine a volumetric displacement for a variable displacement hydraulic pump based, at least in part, on a fuel map;

drive the variable displacement hydraulic pump by the engine;

pump hydraulic fluid from the variable displacement hydraulic pump to an intensifier;

pressurize an output fluid by the intensifier; and pump the pressurized output fluid from the intensifier at a determined pressure and volume.

14. The non-transitory computer-readable medium of claim 13, wherein the one or more executable instructions, when executed, further cause the one or more processors to create the fuel map based, at least in part, on any one or more of a type of the engine, a number of available engines, a number of available variable displacement hydraulic pumps, or one or more operating modes for the number of available engines.

15. The non-transitory computer-readable medium of claim 13, wherein the one or more executable instructions, when executed, further cause the one or more processors to adjust a volumetric displacement of the variable displacement hydraulic pump to maintain the operating mode of the engine.

16. The non-transitory computer-readable medium of claim 13, wherein the engine comprises a plurality of engines, wherein the variable displacement hydraulic pump comprises a plurality of variable displacement hydraulic pumps, and the intensifier comprises a plurality of intensifiers.

17. The non-transitory computer-readable medium of claim 16, wherein the one or more executable instructions, when executed, further cause the one or more processors to adjust, individually, the volumetric displacement of each of the plurality of variable displacement hydraulic pumps to maintain the operating mode of the engine.

18. The non-transitory computer-readable medium of claim 16, wherein the one or more executable instructions, when executed, further cause the one or more processors to:

select at least one engine from the plurality of engines;

set a speed for each of the selected engines based, at least in part on the fuel map;

select at least one variable displacement hydraulic pump from the plurality of variable displacement hydraulic pumps;

set a volumetric displacement for each of the selected variable displacement hydraulic pumps based, at least in part on the fuel map; and route the hydraulic fluid to at least one of the plurality of intensifiers, wherein the routing is based, at least in part, on maintaining a pressure and a volume of the output fluid.

19. The non-transitory computer-readable medium of claim 18, wherein the one or more executable instructions, when executed, further cause the one or more processors to control the routing of the hydraulic fluid via an intensifier control system.

* * * * *